US009033379B2

(12) United States Patent
Tateishi et al.

(10) Patent No.: US 9,033,379 B2
(45) Date of Patent: May 19, 2015

(54) DOOR HANDLE DEVICE FOR VEHICLE

(75) Inventors: Masashi Tateishi, Nagoya (JP); Eiji Mushiake, Chita-gun (JP); Hiroki Okada, Toyota (JP); Ryuta Atsumi, Toyota (JP); Shigeki Nishiyama, Toyota (JP)

(73) Assignees: AISIN SEIKI KABUSHIKI KAISHA, Kariya-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 669 days.

(21) Appl. No.: 13/186,914

(22) Filed: Jul. 20, 2011

(65) Prior Publication Data

US 2012/0019014 A1 Jan. 26, 2012

(30) Foreign Application Priority Data

Jul. 26, 2010 (JP) ..... 2010-167428

(51) Int. Cl.

| | |
|---|---|
| ***E05B 3/00*** | (2006.01) |
| ***E05B 81/78*** | (2014.01) |
| ***E05B 85/16*** | (2014.01) |
| *E05B 65/10* | (2006.01) |

(52) U.S. Cl.

CPC ..... *E05B 81/78* (2013.01); *E05B 85/16* (2013.01); *E05B 81/77* (2013.01)

USPC ..... 292/336.3; 340/5.72

(58) Field of Classification Search

USPC ..... 292/336.3; 340/5.72

See application file for complete search history.

(56) References Cited

U.S. PATENT DOCUMENTS

| | | | | |
|---|---|---|---|---|
| 6,698,262 | B2 * | 3/2004 | Wittwer | 70/208 |
| 7,091,823 | B2 * | 8/2006 | Ieda et al. | 340/5.72 |
| 7,819,442 | B2 * | 10/2010 | Ieda et al. | 292/336.3 |
| 7,931,314 | B2 * | 4/2011 | Nitawaki et al. | 292/336.3 |
| 7,984,937 | B2 * | 7/2011 | Tanimoto et al. | 292/336.3 |

(Continued)

FOREIGN PATENT DOCUMENTS

| | | |
|---|---|---|
| CN | 101037908 A | 9/2007 |
| EP | 2 148 025 A2 | 1/2010 |

(Continued)

OTHER PUBLICATIONS

Extended European Search Report dated Sep. 28, 2012, issued by the European Patent Office in the corresponding European Patent Application No. 11175286.1. (4 pages).

(Continued)

*Primary Examiner* — Carlos Lugo

(74) *Attorney, Agent, or Firm* — Buchanan Ingersoll & Rooney PC

(57) ABSTRACT

A door handle device for a vehicle includes a door handle configured to be supported by a door panel, the door handle including a first handle case arranged to have a void relative to the door panel, a second handle case fixed to the first handle case at a side opposite from the door panel, and a lock command detection sensor including a lock detection signal processing circuit fixed to an inner side of the first handle case, a circuit connection portion electrically connected to the lock detection signal processing circuit, and a lock detection electrode assembled on the second handle case in a state to be arranged along an inner surface of the second handle case, the lock detection electrode being electrically connected to the circuit connection portion in a state where the second handle case is fixed to the first handle case.

16 Claims, 5 Drawing Sheets

(56) References Cited

U.S. PATENT DOCUMENTS

| | | | | |
|---|---|---|---|---|
| 7,984,938 | B2 * | 7/2011 | Tanimoto et al. | 292/336.3 |
| 8,382,170 | B2 * | 2/2013 | Ieda et al. | 292/336.3 |
| 8,403,384 | B2 * | 3/2013 | Ieda et al. | 292/336.3 |
| 8,408,610 | B2 * | 4/2013 | Ieda et al. | 292/336.3 |
| 8,454,062 | B2 * | 6/2013 | Rohlfing et al. | 292/336.3 |
| 8,562,037 | B2 * | 10/2013 | Ieda et al. | 292/336.3 |
| 2007/0126246 | A1 * | 6/2007 | Suzuki et al. | 292/336.3 |
| 2007/0216174 | A1 * | 9/2007 | Tanimoto et al. | 292/336.3 |
| 2007/0216175 | A1 * | 9/2007 | Tanimoto et al. | 292/336.3 |
| 2008/0061933 | A1 * | 3/2008 | Ieda et al. | 340/5.72 |
| 2008/0068129 | A1 | 3/2008 | Ieda et al. | |
| 2010/0019510 | A1 | 1/2010 | Ieda et al. | |
| 2010/0187838 | A1 | 7/2010 | Ieda et al. | |
| 2010/0192329 | A1 | 8/2010 | Ieda et al. | |
| 2012/0133159 | A1 | 5/2012 | Tateishi et al. | |

FOREIGN PATENT DOCUMENTS

| | | | |
|---|---|---|---|
| EP | 2 177 695 | A1 | 4/2010 |
| FR | 2 906 086 | A1 | 3/2008 |
| JP | 3502848 | B2 | 3/2004 |
| JP | 2006-074750 | A | 3/2006 |
| JP | 2008-083025 | A | 4/2008 |
| JP | 4079646 | B2 | 4/2008 |

OTHER PUBLICATIONS

Office Action from the State Intellectual Property Office of People's Republic of China dated Dec. 3, 2014, issued in corresponding Chinese Patent Application No. 20110216675.6, with English translation of the Office Action. (14 pages).

* cited by examiner

DOOR HANDLE DEVICE FOR VEHICLE

CROSS REFERENCE TO RELATED APPLICATIONS

This application is based on and claims priority under 35 U.S.C. §119 to Japanese Patent Application 2010-167428, filed on Jul. 26, 2010, the entire content of which is incorporated herein by reference.

TECHNICAL FIELD

This disclosure generally relates to a door handle device for a vehicle.

BACKGROUND DISCUSSION

A known door handle device is applicable to a locking system (i.e., a smart entry system) in which a communication is made between a portable device carried by a driver of the vehicle and a main body provided at the vehicle so as to authenticate the portable device. In a case where the authentication is successful, a door of the vehicle is automatically locked and unlocked accordingly. According to a known door handle device for a vehicle such as disclosed in JP4079646B2, a lock detection signal processing circuit to which a circuit connection portion is electrically connected and fixed beforehand is fixed to an inner side of a first handle case. A lock detection electrode is integrally formed with the circuit connection portion by a metallic material. Therefore, the lock detection electrode is supported by the first handle case via the circuit connection portion and the lock detection signal processing circuit. In a state where a second handle case is fixed to the first handle case, the lock detection electrode is assembled so as to be arranged along an inner surface of the second handle case.

Thus, in a case where a shape and/or dimensions of the second handle case is changed, for example, the lock detection electrode may not be assembled so as to be arranged along a predetermined portion at the inner surface of the second handle case when the second handle case is fixed to the first handle case. In such case, in order to assemble the lock detection electrode to be arranged along the predetermined portion at the inner surface of the second handle case, dimensions of the circuit connection portion may be changed to thereby fix the lock detection signal processing circuit, to which the circuit connection portion is electrically connected and fixed beforehand, to the inner side of the first handle case, or a shape and/or dimensions of the first handle case may be changed, for example. Accordingly, in a case of aiming to avoid an increase of a manufacturing cost without changes of the dimensions of the circuit connection portion or the shape and/or dimensions of the first handle case when changing the shape and/or dimensions of the second handle case, a flexibility of changing the shape and/or dimensions of the second handle case may decrease.

A need thus exists for a door handle device for a vehicle which is not susceptible to the drawback mentioned above.

SUMMARY

According to an aspect of this disclosure, a door handle device for a vehicle includes a door handle configured to be supported by a door panel and being rotatable in an outward direction of the door panel, the door handle including a first handle case arranged to have a void relative to the door panel, a second handle case fixed to the first handle case at a side opposite from the door panel, and a lock command detection sensor detecting a lock command based on a capacitance, the lock command detection sensor including a lock detection signal processing circuit fixed to an inner side of the first handle case, a circuit connection portion electrically connected to the lock detection signal processing circuit, and a lock detection electrode assembled on the second handle case in a state to be arranged along an inner surface of the second handle case, the lock detection electrode being electrically connected to the circuit connection portion in a state where the second handle case is fixed to the first handle case.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
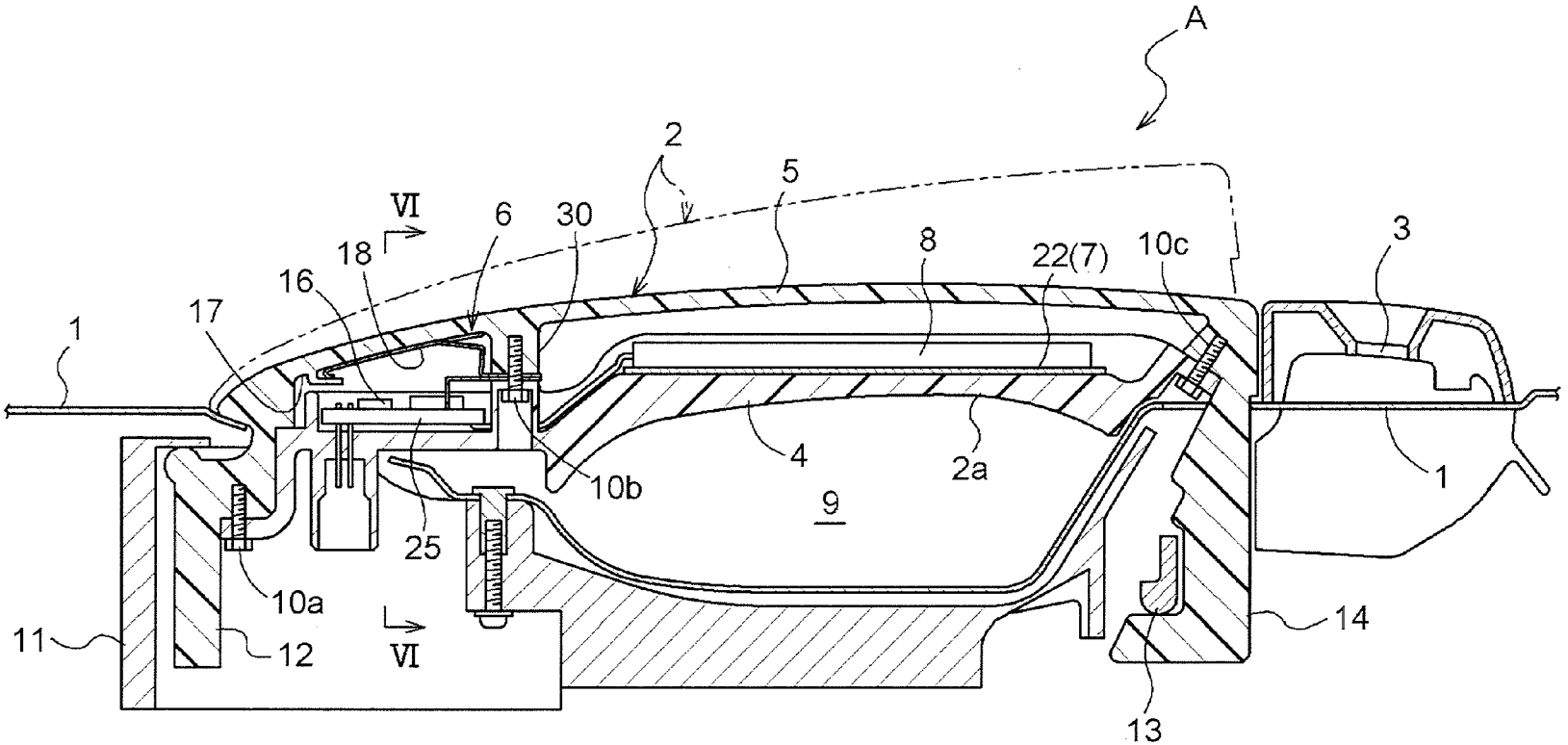
FIG. 1 is a horizontal cross-sectional view of a door for a vehicle where a door handle device for a vehicle according to an embodiment is mounted.
Figure 2:
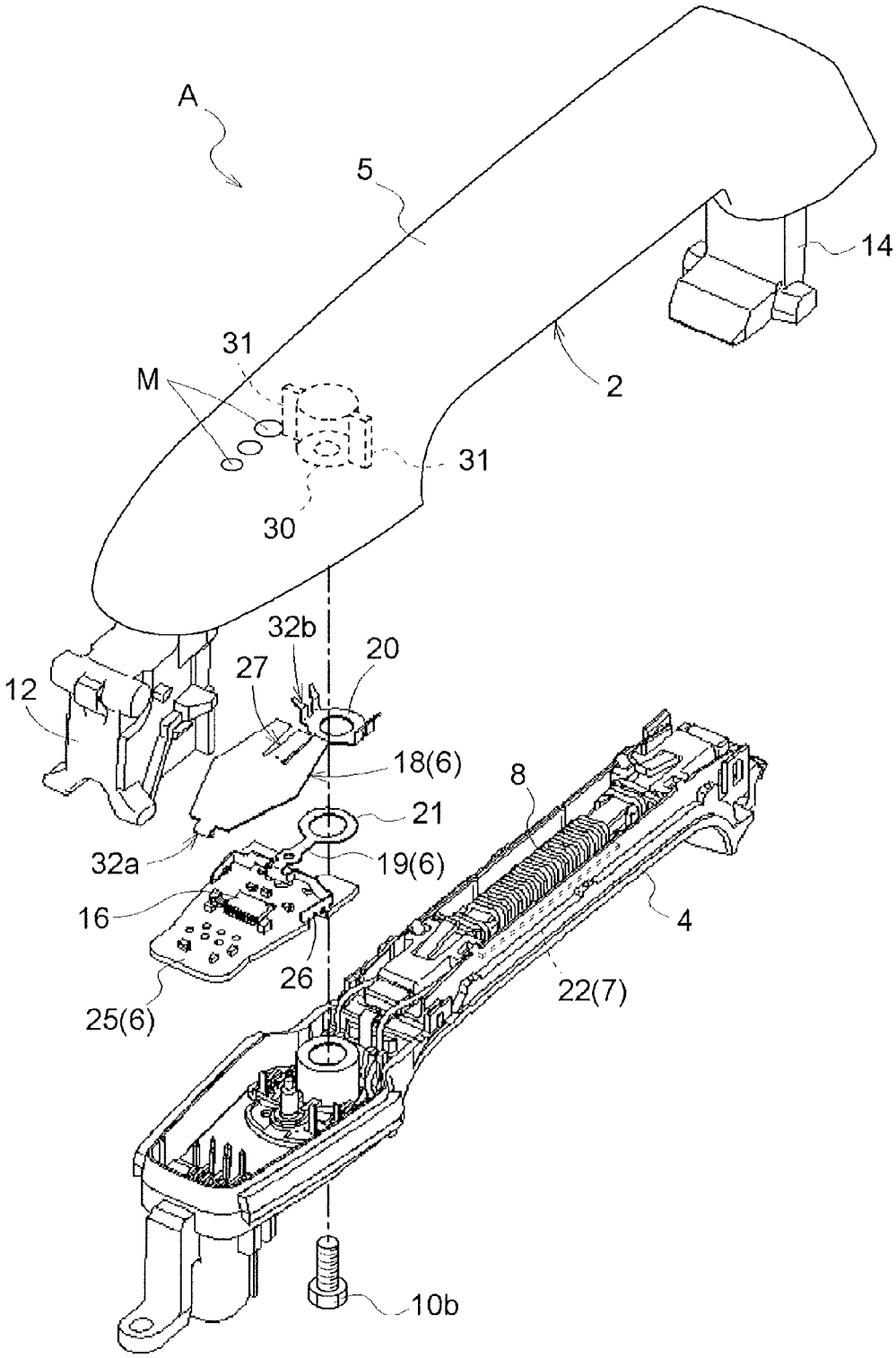
FIG. 2 is an exploded perspective view of the door handle device.

A door handle device for a vehicle according to an embodiment when being applied to a locking system (i.e., a smart entry system) will be explained with reference to the attached drawings. In the embodiment, directions and orientations such as left, right, front, rear, top, and bottom correspond to those of the vehicle where the door handle device is mounted. As illustrated in FIGS. 1 and 2, a door handle device for a vehicle (hereinafter simply referred to as a door handle device) A includes a door handle 2 supported by a door panel 1 so as to be rotatable in an outward direction of a door for the vehicle (i.e., the door panel 1), and an auxiliary lock 3 brought in a locked state or an unlocked state by a key plate. The door handle 2 is arranged in such a manner that a longitudinal direction thereof corresponds to a longitudinal direction of the vehicle. The auxiliary lock 3 is arranged at the rear of the door handle 2.

The door handle 2 includes a first handle case 4 made of resin, a second handle case 5 made of resin, a lock command detection sensor 6 detecting a lock command based on a capacitance, an unlock command detection sensor 7 detecting an unlock command based on a capacitance, and an antenna 8 communicating with a portable device carried by a driver of the vehicle, for example.

The first handle case 4 is arranged so as to have a void 9 relative to the door panel 1. A grip portion 2*a* is formed at the first handle case 4 so as to face the void 9. The second handle case 5 is fixed to the first handle case 4 via screws 10*a*, 10*b*, and 10*c* screwed from a side where the first handle case 4 is provided. The second handle case 5 is positioned at an opposite side from the door panel 1 relative to the first handle case 4.

In order to support the door handle 2 so as to be rotatable relative to the door panel 1, a rotating support portion 12 is integrally formed at a front portion of the second handle case 5 in the longitudinal direction of the vehicle. Specifically, the rotating support portion 12 is positioned at an inner side of the door panel 1 so as to be rotatably supported by a support member 11 fixed to the inner side of the door panel 1.

In addition, an operating portion 14 is integrally formed at a rear portion of the second handle case 5 in the longitudinal direction of the vehicle. The operating portion 14 is positioned at the inner side of the door panel 1 so as to operate an opening and closing lever 13 of a door opening and closing mechanism provided at the inner side of the door panel 1 by a rotating operation of the door handle 2.

The lock command detection sensor 6 includes an IC board 16, a lock detection electrode 18, and a lock detection circuit connecting portion 19 serving as a circuit connection portion. The IC board 16 includes a lock detection signal processing circuit 15 (see FIG. 7) fixed to an inner side of the first handle case 4. The lock detection electrode 18 is assembled on the second handle case 5 in a state to be arranged along an inner surface 17 of the second handle case 5, the inner surface 17 being substantially parallel to a surface (a plate surface) of the door panel 1. The lock detection circuit connecting portion 19 is electrically connected to the lock detection signal processing circuit 15 and the lock detection electrode 18.

Specifically, the lock detection electrode 18 is electrically connected to the lock detection circuit connecting portion 19 by bringing an electrode connection ring 20 and a circuit connection ring 21 (which will be explained later) to be electrically connected to each other in a state where the second handle case 5 is fixed to the first handle case 4. The lock detection circuit connecting portion 19 is electrically connected to the lock detection signal processing circuit 15 beforehand.

The unlock command detection sensor 7 includes an unlock detection electrode 22 and an unlock detection signal processing circuit. The unlock detection electrode 22 is assembled on the first handle case 4 in a state to be arranged along an inner surface of the grip portion 2*a* formed at the first handle case 4. The unlock detection signal processing circuit is electrically connected to the unlock detection electrode 22. The unlock detection signal processing circuit is provided at the IC board 16 where the lock detection signal processing circuit 15 is also provided.

The IC board 16 including the lock detection signal processing circuit 15 and the unlock detection signal processing circuit is mounted at a circuit board 25 fixed to a front portion of the first handle case 4 so as to face the lock detection electrode 18. In addition, a transmitting and receiving circuit for the antenna 8 is also mounted at the circuit board 25.

The lock detection electrode 18 is assembled on the front portion of the second handle case 5 in the longitudinal direction. The unlock detection electrode 22 and the antenna 8 are assembled on a rear portion of the first handle case 4 in the longitudinal direction relative to the circuit board 25 in a state where the antenna 8 is arranged to overlap the unlock detection electrode 22 at a side facing the second handle case 5.

Figure 3:
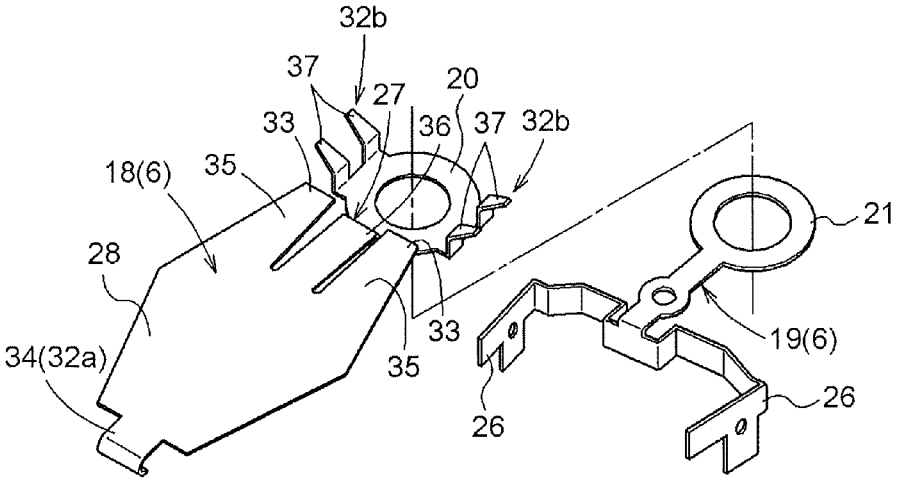
FIG. 3 is an exploded perspective view of a lock detection electrode and a lock detection circuit contact portion of the door handle device.

As illustrated in FIG. 3, the lock detection circuit connecting portion 19 integrally includes a pair of circuit connection terminals 26 electrically connected to the lock detection signal processing circuit 15, and the circuit connection ring 21 electrically connected to the electrode connection ring 20 provided at an end of a pressing portion 27 (which will be explained later) of the lock detection electrode 18.

The circuit connection terminals 26 are integrally fixed to the circuit board 25 beforehand by resin or the like so as to be electrically connected to the lock detection signal processing circuit 15. The unlock detection electrode 22 is also integrally fixed to the circuit board 25 beforehand by resin or the like so as to be electrically connected to the unlock detection signal processing circuit. Further, the antenna 8 is integrally fixed to the circuit board 25 beforehand by resin or the like so as to be electrically connected to the transmitting and receiving circuit.

As illustrated in FIG. 3, the lock detection electrode 18 is obtained by a sheet-metal processing performed on a metallic plate made of phosphor bronze or the like. The lock detection electrode 18 integrally includes an electrode body 28 having a plate shape and the pressing portion 27 having a band plate shape. The electrode body 28 is elastically deformable and is arranged along the inner surface 17 of the second handle case 5 so that a surface (a plate surface) of the electrode body 28 is in contact with the inner surface 17. The pressing portion 27 is also elastically deformable so as to press the electrode body 28 towards the inner surface 17 of the second handle case 5.

Figure 4A:
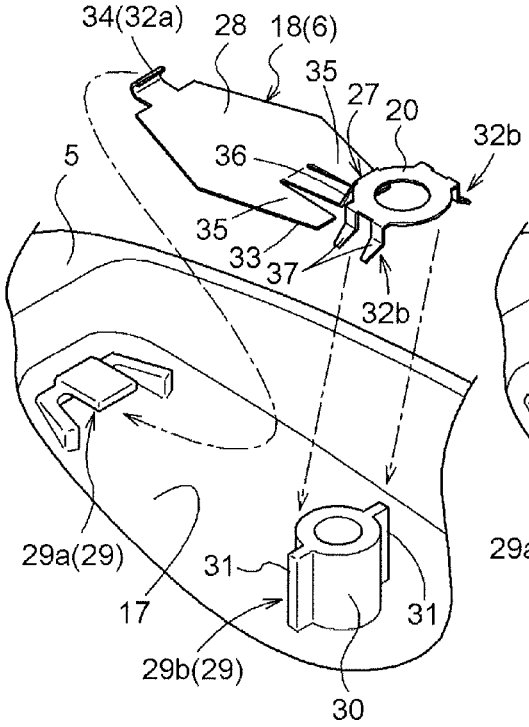
FIGS. 4A and 4B are perspective views each illustrating a method for assembling the lock detection electrode.
Figure 4B:
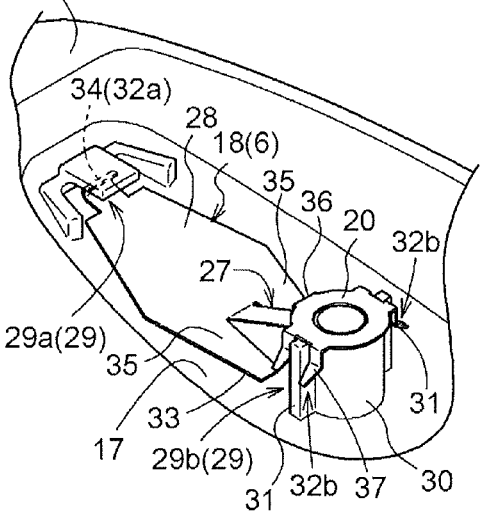

As illustrated in FIGS. 4A and 4B, the second handle case 5 includes an engagement mechanism 29 at an inner side so that the lock detection electrode 18 is engageable with the second handle case 5. The engagement mechanism 29 includes a first engagement portion 29*a* engaging with one end (i.e., a first end) of the lock detection electrode 18 in the longitudinal direction of the door handle 2 and a second engagement portion 29*b* engaging with the other end (i.e., a second end) of the lock detection electrode 18 in the longitudinal direction of the door handle 2.

The first engagement portion 29*a* includes an engagement bore formed at the front portion of the second handle case 5 in the longitudinal direction. The second engagement portion 29*b* includes a pair of ribs 31 integrally formed at an outer circumferential portion of a boss 30 while the ribs 31 have an interval therebetween in the circumferential direction of the boss 30. The boss 30 is formed at the rear portion of the second handle case 5 in the longitudinal direction relative to the first engagement portion 29*a*. The screw 10*b* is inserted into the boss 30 so as to fix the second handle case 5 with the first handle case 4.

As illustrated in FIG. 3, the electrode body 28 includes a first hook portion 32*a* (fitting portion) at the first end so as to be engaged with the first engagement portion 29*a*. The electrode body 28 also includes a contact portion 33 in the rear of the first hook portion 32*a* in the longitudinal direction so as to be away from the first hook portion 32*a*. The contact portion 33 makes contact with the inner surface 17 of the second handle case 5.

The first hook portion 32*a* is formed by a bending of an extending piece 34 that extends from a front end of the electrode body 28. The contact portion 33 is formed by end portions of a pair of extending plates 35 extending from a rear end of the electrode body 28 in a band plate shape while an interval is formed between the extending plates 35.

As illustrated in FIG. 3, the pressing portion 27 extends in the band plate shape from a portion between the pair of extending plates 35 of the electrode body 28 so that the pressing portion 27 is integrally connected to a portion between the first hook portion 32*a* and the contact portion 33 of the electrode body 28. The electrode connection ring 20 is integrally formed at an end of the pressing portion 27 so as to be sandwiched and held, together with the circuit connection ring 21, between the boss 30 of the second handle case 5 and the first handle case 4. The electrode connection ring 20 and the circuit connection ring 21 (the second handle case 5 and the first handle case 4) are tightened together by the screw 10*b*.

Figure 5:
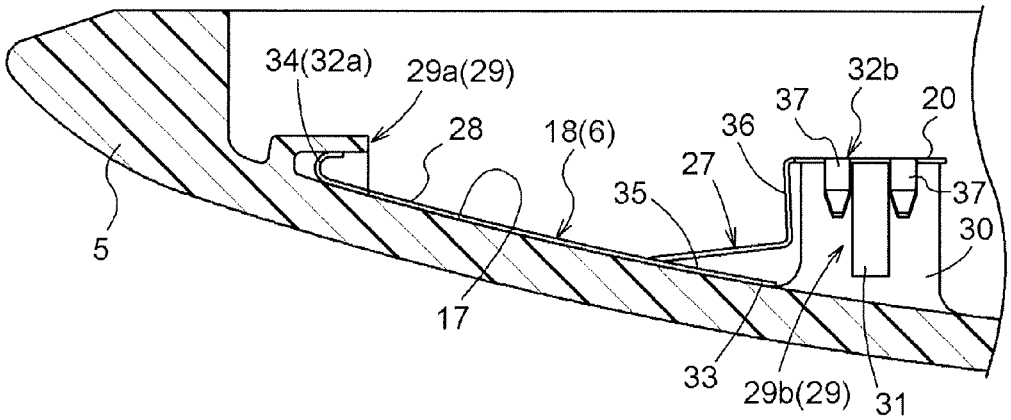
FIG. 5 is a cross-sectional view illustrating an assembly state of the lock detection electrode.

The pressing portion 27 includes a bending portion 36 obtained by bending at substantially an intermediate portion of the pressing portion 27 in the longitudinal direction as illustrated in FIG. 5 so that the pressing portion 27 is elastically deformable by a bending deformation of the bending portion 36. A second hook portion 32*b* is formed at an end of the pressing portion 27. Specifically, the second hook portion 32*b* is provided at the second end of the lock detection electrode 18 so as to engage with the second engagement portion 29*b*.

The second hook portion 32*b* includes two pairs of claws 37 extending from the electrode connection ring 20 as illustrated in FIG. 3. Then, each of the ribs 31 formed at the boss 30 engages with a portion between each of the pairs of claws 37 as illustrated in FIG. 4B so that the second hook portion 32*b* is engaged with the second engagement portion 29*b*.

A distance between the first hook portion 32*a* and the second hook portion 32*b* is defined to be greater than a distance between the first engagement portion 29*a* and the second engagement portion 29*b*. The extending piece 34 (the first hook portion 32*a*) is inserted into the engagement bore (the first engagement portion 29*a*) while the ribs 31 are inserted into the respective portions between the pairs of claws 37 (the second hook portion 32*b*) as illustrated in FIG. 4B. Then, the lock detection electrode 18 is elastically deformed so that the surface of the electrode body 28 is in contact with the inner surface 17 of the second handle case 5 as illustrated in FIG. 5, thereby engaging the lock detection electrode 18 between the first engagement portion 29*a* and the second engagement portion 29*b*.

Figure 6:
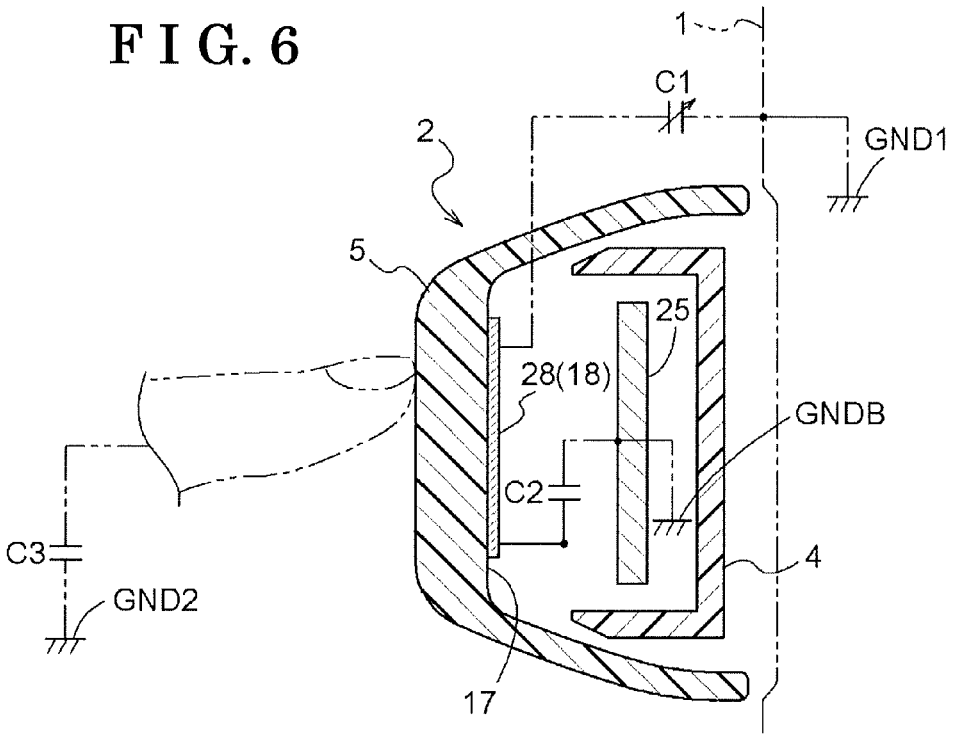
FIG. 6 is a cross-sectional view taken along the line VI-VI in FIG. 1.
Figure 7:
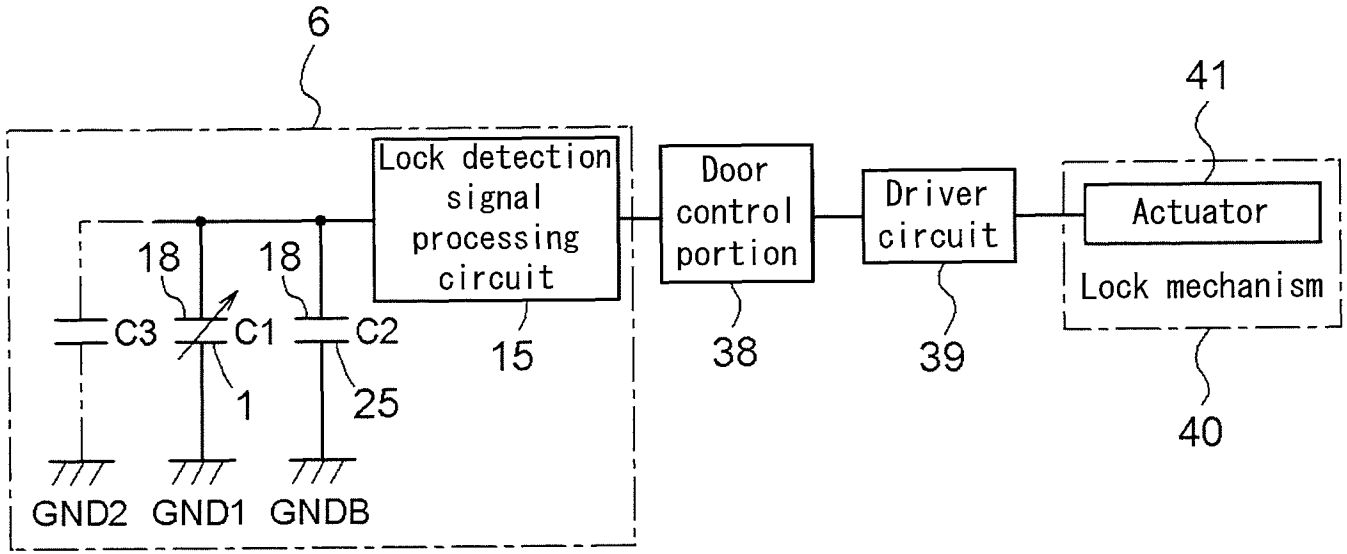
FIG. 7 is a block diagram of a locking system operated on a basis of a detection result of a lock command detection sensor.

FIG. 7 is a block diagram of the locking system operated on a basis of a detection result of the lock command detection sensor 6. As illustrated in FIG. 6, a capacitance (an electrostatic capacity) C1 obtained between the lock detection electrode 18 and the door panel 1 that functions as an earth GND1 and a capacitance (an electrostatic capacity) C2 between the lock detection electrode 18 and the circuit board 25 at which an earth electrode is provided so as to function as an earth GNDB are formed in parallel to each other. A value indicating a combined capacitance that consists of the capacitance C1 and the capacitance C2 is input to the lock detection signal processing circuit 15.

Because a distance between the lock detection electrode 18 and the circuit board 25 is smaller than a distance between the lock detection electrode 18 and the door panel 1, the capacitance C2 formed between the lock detection electrode 18 and the circuit board 25 is greater than the capacitance C1 formed between the lock detection electrode 18 and the door panel 1.

In the aforementioned state, when a user of the vehicle such as a driver touches a mark M (see FIG. 2) or a vicinity thereof by one's hand, the mark M being provided at a portion of the second handle case 5 so as to face the lock detection electrode 18, a capacitance (an electrostatic capacity) C3 is newly obtained between the user of the vehicle functioning as an earth GND2 and the lock detection electrode 18 so as to be parallel to the capacitance C1 and the capacitance C2. Then, a value indicating the combined capacitance that consists of the capacitance C1, the capacitance C2 and the capacitance C3 is input to the lock detection signal processing circuit 15.

When the value indicating the combined capacitance obtained by the capacitance C1, the capacitance C2, and the capacitance C3 is input to the lock detection signal processing circuit 15, a door control portion 38 determines that the door lock command is issued by the user of the vehicle. Therefore, the door control portion 38 drives an actuator (a lock actuator) 41 provided at a lock mechanism 40 via a driver circuit 39 to thereby lock the vehicle door.

According to the aforementioned embodiment, the lock command detection sensor 6 may be assembled on a rotatable end portion (i.e., a rear portion) of the door handle 2.

In addition, the lock detection electrode 18 may be assembled on a position away from the circuit board 25, where the lock detection signal processing circuit 15 is provided, in the longitudinal direction of the door handle 2.

Further, the door handle device A may include the lock detection electrode 18 that is provided at a portion other than a fixing portion between the first handle case 4 and the second handle case 5 and that is electrically connected to the lock detection circuit connecting portion 19 in a state where the second handle case 5 is fixed to the first handle case 4.

Furthermore, the lock detection electrode 18 may be assembled on a portion of the inner surface of the second handle case 5 facing upward or downward when the door handle device A is mounted to the vehicle.

According to the aforementioned embodiment, the door handle device A includes the door handle 2 configured to be supported by the door panel 1 and being rotatable in the outward direction of the door pane 1, the door handle 2 including the first handle case 4 arranged to have the void 9 relative to the door panel 1, the second handle case 5 fixed to the first handle case 4 at a side opposite from the door panel 1, and the lock command detection sensor 6 detecting a lock command based on a capacitance, the lock command detection sensor 6 including the lock detection signal processing circuit 15 fixed to the inner side of the first handle case 4, the circuit connection portion 19 electrically connected to the lock detection signal processing circuit 15, and the lock detection electrode 18 assembled on the second handle case 5 in a state to be arranged along the inner surface 17 of the second handle case 5, the lock detection electrode 18 being electrically connected to the circuit connection portion 19 in a state where the second handle case 5 is fixed to the first handle case 4.

The lock detection electrode 18 and the lock detection circuit connecting portion 19 are electrically connected to each other in a state where the second handle case 5 is fixed to the first handle case 4. Thus, the lock detection circuit connecting portion 19 is provided at the first handle case 4 while the lock detection electrode 18 is provided at the second handle case 5 instead of the first handle case 4. Specifically, the lock detection electrode 18 is assembled so as to be arranged along a predetermined portion at the inner surface 17 of the second handle case 5 while the lock detection signal processing circuit 15 to which the lock detection circuit connecting portion 19 is electrically connected and fixed is fixed to the inner side of the first handle case 4. Therefore, even when a shape and/or dimensions of the second handle case 5 is changed, for example, the lock detection electrode 18 and the lock detection circuit connecting portion 19 are electrically connected to each other in a state where the second handle case 5 is fixed to the first handle case 4, without necessary changes of dimensions of the lock detection circuit connecting portion 19 or a shape and/or dimensions of the first handle case 4. As a result, according to the door handle device A of the present embodiment, a flexibility of the change of the shape and/or dimensions of the second handle case 5 is enhanced while an increase of a manufacturing cost of the door handle device A is being restrained.

In addition, according to the embodiment, the door handle device A further includes the engagement mechanism 29 engaging the lock detection electrode 18 relative to the second handle case 5.

Accordingly, in a case of fixing the second handle case 5 to the first handle case 4, the lock detection electrode 18 is brought to engage with the second handle case 5 so as not to remove or disengage from the second handle case 5. As a result, the second handle case 5 may be easily fixed to the first handle case 4.

Further, according to the embodiment, the engagement mechanism 29 includes the first engagement portion 29*a* engageable with the first end of the lock detection electrode 18 in the longitudinal direction of the door handle 2 and the second engagement portion 29*b* engageable with the second end of the lock detection electrode 18 in the longitudinal direction of the door handle 2, and wherein the lock detection electrode 18 is engaged between the first engagement portion 29*a* and the second engagement portion 29*a* while being elastically deformed.

Accordingly, the lock detection electrode 18 is securely engaged between the first engagement portion 29*a* and the second engagement portion 29*b* by means of an elastic restoring force of the lock detection electrode 18.

Furthermore, according to the embodiment, the lock detection electrode 18 includes the electrode body 28 having a plate shape and being elastically deformable, the electrode body 28 including the first hook portion 32*a* (the fitting portion) with which one of the first engagement portion 29*a* and the second engagement portion 29*b* engages and the contact portion 33 making contact with the inner surface 17 of the second handle case 5 at a position away from the first hook portion 32*a* in the longitudinal direction, and the lock detection electrode 18 further includes the pressing portion 27 integrally connected to a portion between the first hook portion 32*a* and the contact portion 33 of the electrode body 28, the other of the first engagement portion 29*a* and the second engagement portion 29*b* engaging with the pressing portion 27, the pressing portion 27 being elastically deformable to press the electrode body 28 towards the inner surface 17 of the second handle case 5.

Accordingly, the first hook portion 32*a* (fitting portion) of the electrode body 28 is engaged with one of the first engagement portion 29*a* and the second engagement portion 29*b* while the pressing portion 27 integrally connected to the portion between the first hook portion 32*a* and the contact portion 33 of the electrode body 28 is engaged with the other of the first engagement portion 29*a* and the second engagement portion 29*b*. The pressing portion 27 is elastically deformed so as to press the electrode body 28 to the inner surface 17 of the second handle case 5. As a result, the plate-shaped electrode body 28 of which the contact portion 33 is in contact with the inner surface 17 of the second handle case 5 at a position away from the first hook portion 32*a* in the longitudinal direction is elastically deformed towards the inner surface 17 of the second handle case 5 so as to be assembled and arranged along the inner surface 17 of the second handle case 5. The electrode body 28 may be easily assembled so as to be arranged along the inner surface 17 of the second handle case 5 accordingly.

Furthermore, according to the embodiment, the circuit board 25 where the lock detection signal processing circuit 15 is provided is fixed to the first handle case 4 to face the lock detection electrode 18.

According to the door handle device where the lock command detection sensor detecting the lock command based on changes in capacity is provided at the door handle, the capacitance formed between the lock detection electrode provided at the door handle and the door panel varies when the door handle rotates relative to the door panel. Thus, the lock command detection sensor may wrongly detect the lock command based on the rotating operation of the door handle. According to the present embodiment, the capacitance C2 is formed between the lock detection electrode 18 and the circuit board 25 on a basis of the earth GND that is defined by the earth electrode provided at the circuit board 25 so as to be arranged in parallel to the capacitance C1 formed between the lock detection electrode 18 and the door panel 1. Because the distance between the lock detection electrode 18 and the circuit board 25 is smaller than the distance between the lock detection electrode 18 and the door panel 1, the capacitance formed between the lock detection electrode 18 and the circuit board 25 is greater than the capacitance formed between the lock detection electrode 18 and the door panel 1. As a result, the lock command detection sensor 6 detects whether or not the lock command is issued on a basis of changes in the combined capacitance where the large capacitance formed between the lock detection electrode 18 and the circuit board 25 is added to the capacitance formed between the lock detection electrode 18 and the door panel 1. Accordingly, changes in capacitance caused by the rotating operation of the door handle 2 decreases, thereby inhibiting the lock command detection sensor 6 from wrongly detecting the lock command on a basis of the rotating operation of the door handle 2.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle device for a vehicle, comprising:

a door handle configured to be supported by a door panel and being rotatable in an outward direction of the door panel, the door handle including a first handle case arranged to have a void relative to the door panel, a second handle case fixed to the first handle case at a side opposite from the door panel, and a lock command detection sensor detecting a lock command based on a capacitance;

the lock command detection sensor including a lock detection signal processing circuit fixed to an inner side of the first handle case, a circuit connection portion electrically connected to the lock detection signal processing circuit, and a lock detection electrode assembled on the second handle case along an inner surface of the second handle case, wherein, the lock detection electrode is electrically connected to the circuit connection portion when the second handle case is fixed to the first handle case, the lock detection electrode is not electrically connected to the circuit connection portion when the second handle case is not fixed to the first handle case, and the circuit connection portion includes a pair of circuit connection terminals which are electrically connected to the lock detection signal processing circuit and a circuit connection ring which is electrically connected to the lock detection electrode.

2. The door handle device according to claim 1, further comprising an engagement mechanism engaging the lock detection electrode relative to the second handle case when the second handle case is not fixed to the first handle case.

3. The door handle device according to claim 2, wherein the engagement mechanism includes a first engagement portion engageable with a first end of the lock detection electrode in a longitudinal direction of the door handle and a second engagement portion engageable with a second end of the lock detection electrode in the longitudinal direction of the door handle, and wherein the lock detection electrode is engaged between the first engagement portion and the second engagement portion while being elastically deformed.

4. The door handle device according to claim 3, wherein the lock detection electrode includes an electrode body having a plate shape and being elastically deformable, the electrode body including a fitting portion with which one of the first engagement portion and the second engagement portion engages and a contact portion making contact with the inner surface of the second handle case at a position away from the fitting portion in the longitudinal direction, and the lock detection electrode further includes a pressing portion integrally connected to a portion between the fitting portion and the contact portion of the electrode body, the other of the first engagement portion and the second engagement portion engaging with the pressing portion, the pressing portion being elastically deformable to press the electrode body towards the inner surface of the second handle case.

5. The door handle device according to claim 1, wherein a circuit board where the lock detection signal processing circuit is provided is fixed to the first handle case to face the lock detection electrode.

6. The door handle device according to claim 1, wherein the lock detection electrode includes an electrode body assembled on the second handle case in a state to be arranged along the inner surface of the second handle case, a pressing portion pressing the electrode body towards the second handle case, and an electrode connection ring brought in electrical contact with the circuit connection portion.

7. The door handle device according to claim 1, wherein the circuit connection portion includes a pair of circuit connection terminals which are electrically connected to the lock detection signal processing circuit and a circuit connection ring which is electrically connected to the lock detection electrode, the lock detection electrode includes an electrode body assembled on the second handle case in a state to be arranged along the inner surface of the second handle case, a pressing portion pressing the electrode body towards the second handle case, and an electrode connection ring brought in electrical contact with the circuit connection portion, the electrode connection ring and the circuit connection ring are tightened together by a screw.

8. The door handle device according to claim 1, wherein each of the first handle case and the second handle case is a resin material, and the lock detection electrode is a metallic plate including phosphor bronze.

9. The door handle device according to claim 1, further comprising:

an unlock detection electrode assembled on the first handle case; and an unlock detection signal processing circuit.

10. A door handle device for a vehicle, comprising:

a door handle configured to be supported by a door panel and being rotatable in an outward direction of the door panel, the door handle including a first handle case arranged to have a void relative to the door panel, a second handle case fixed to the first handle case at a side opposite from the door panel, and a lock command detection sensor detecting a lock command based on a capacitance;

the lock command detection sensor including a lock detection signal processing circuit fixed to an inner side of the first handle case, a circuit connection portion electrically connected to the lock detection signal processing circuit, and a lock detection electrode assembled on the second handle case in a state to be arranged along an inner surface of the second handle case, the lock detection electrode being electrically connected to the circuit connection portion in a state where the second handle case is fixed to the first handle case;

an engagement mechanism engaging the lock detection electrode relative to the second handle case, wherein the engagement mechanism includes a first engagement portion engageable with a first end of the lock detection electrode in a longitudinal direction of the door handle and a second engagement portion engageable with a second end of the lock detection electrode in the longitudinal direction of the door handle, and wherein the lock detection electrode is engaged between the first engagement portion and the second engagement portion while being elastically deformed.

11. The door handle device according to claim 10, wherein the circuit connection portion includes a pair of circuit connection terminals which are electrically connected to the lock detection signal processing circuit and a circuit connection ring which is electrically connected to the lock detection electrode.

12. The door handle device according to claim 10, wherein the lock detection electrode includes an electrode body assembled on the second handle case in a state to be arranged along the inner surface of the second handle case, a pressing portion pressing the electrode body towards the second handle case, and an electrode connection ring brought in electrical contact with the circuit connection portion.

13. The door handle device according to claim 10, wherein the circuit connection portion includes a pair of circuit connection terminals which are electrically connected to the lock detection signal processing circuit and a circuit connection ring which is electrically connected to the lock detection electrode, the lock detection electrode includes an electrode body assembled on the second handle case in a state to be arranged along the inner surface of the second handle case, a pressing portion pressing the electrode body towards the second handle case, and an electrode connection ring brought in electrical contact with the circuit connection portion, the electrode connection ring and the circuit connection ring are tightened together by a screw.

14. The door handle device according to claim 10, wherein each of the first handle case and the second handle case is a resin material, and the lock detection electrode is a metallic plate including phosphor bronze.

15. The door handle device according to claim 10, further comprising:

an unlock detection electrode assembled on the first handle case; and an unlock detection signal processing circuit.

16. A door handle device for a vehicle, comprising:

a door handle configured to be supported by a door panel and being rotatable in an outward direction of the door panel, the door handle including a first handle case arranged to have a void relative to the door panel, a second handle case fixed to the first handle case at a side opposite from the door panel, and a lock command detection sensor detecting a lock command based on a capacitance;

the lock command detection sensor including a lock detection signal processing circuit fixed to an inner side of the first handle case, a circuit connection portion electrically connected to the lock detection signal processing circuit, and a lock detection electrode assembled on the second handle case along an inner surface of the second handle case, wherein, the lock detection electrode is electrically connected to the circuit connection portion when the second handle case is fixed to the first handle case, the lock detection electrode is not electrically connected to the circuit connection portion when the second handle case is not fixed to the first handle case, the lock detection electrode includes an electrode body assembled on the second handle case in a state to be arranged along the inner surface of the second handle case, a pressing portion pressing the electrode body towards the second handle case, and an electrode connection ring brought in electrical contact with the circuit connection portion.

* * * * *